United States Patent [19]

Murai et al.

[11] Patent Number: 4,996,138

[45] Date of Patent: Feb. 26, 1991

[54] SILVER HALIDE PHOTOGRAPHIC LIGHT-SENSITIVE MATERIAL

[75] Inventors: Kazuhiro Murai, Odawara; Yasuhiko Kawashima, Hino; Shun Takada, Odawara; Nobuaki Kagawa, Hachioji, all of Japan

[73] Assignee: Konica Corporation, Tokyo, Japan

[21] Appl. No.: 414,711

[22] Filed: Sep. 29, 1989

[30] Foreign Application Priority Data

Oct. 4, 1988 [JP] Japan ..... 63-250713

[51] Int. Cl.[5] ..... G03C 1/06

[52] U.S. Cl. ..... 430/522; 430/963

[58] Field of Search ..... 430/522, 963

[56] References Cited

U.S. PATENT DOCUMENTS

| | | | |
|---|---|---|---|
| 3,984,246 | 10/1976 | Ohlschlager et al. | 430/522 |
| 4,895,786 | 1/1990 | Kurematsu et al. | 430/522 |
| 4,933,268 | 6/1990 | Ohno et al. | 430/522 |
| 4,945,033 | 7/1990 | Deguchi et al. | 430/522 |

FOREIGN PATENT DOCUMENTS

| | | | |
|---|---|---|---|
| 0243096 | 10/1987 | European Pat. Off. . | |
| 0286331 | 10/1988 | European Pat. Off. | 430/522 |
| 2540833 | 1/1976 | Fed. Rep. of Germany | 430/522 |
| 56-130747 | 10/1981 | Japan . | |
| 58-143342 | 8/1983 | Japan . | |
| 60-166947 | 8/1985 | Japan . | |
| 61-289346 | 12/1986 | Japan . | |

*Primary Examiner*—Paul R. Michl
*Assistant Examiner*—T. Neville
*Attorney, Agent, or Firm*—Finnegan, Henderson, Farabow, Garrett, and Dunner

[57] ABSTRACT

There is provided a silver halide photographic light-sensitive material comprising a support and photographic layers containing at least one silver halide emulsion layer thereon. At least one silver halide emulsion layer contains a silver halide grains having a silver chloride content of not less than 90 mol % and silver bromide content of not less than 0.05 mol % and at least one photographic layer contains a specific oxanol dye. The silver halide photographic light-sensitive material is suitable for rapid processing and excellent in image-sharpness.

10 Claims, No Drawings

SILVER HALIDE PHOTOGRAPHIC LIGHT-SENSITIVE MATERIAL

FIELD OF THE INVENTION

This invention relates to a silver halide photographic light-sensitive material and, particularly, to a silver halide photographic light-sensitive material suitable for a rapid-processing and excellent in image-sharpness.

BACKGROUND OF THE INVENTION

Recently in the photographic industry, there have been demands for a silver halide photographic light-sensitive material to be rapidly processed, to have high quality images, and to keep stable and constant characteristics.

To be more precise, silver halide photographic light-sensitive materials have usually been processed continuously with an automatic processor installed at every photofinishing laboratory. On the other hand, there have been requirements for the laboratories, as a part of their customer services, to return finished products to every customer within the every day of the acceptance of their customer's orders and, more recently, there have been the increased requirements of rapid processing to return the finished products within several hours time from the acceptance of orders. In addition, further rapid processing services have been required from the viewpoints that the production efficiency can be improved and the production cost can also be reduced by shortening the processing time. The approaches to achieve a rapid processing have been made from the aspects of both light-sensitive materials and processing solutions. For the color developing treatments, some attempts have been made, such as the treatments at a high temperature, a high pH, and/or a high concentration of a color developing agent and, further, it has been well known to add a development accelerator. Such development accelerators are, for example, 1-phenyl-3-pyrazol-idone disclosed in British Patent No. 811,185, N-methyl-p-aminophenol disclosed in British Patent No. 2,417,514, and N,N,N,,N,,-tetramethyl-p-phenylenediamine disclosed in Japanese Patent Publication Open to Public Inspection (hereinafter referred to as Japanese Patent O.P.I. Publication) No. 50-15554(1975). In the above-mentioned methods, however, a satisfactory rapidness may not be achieved and the characteristic deteriorations such as a fog-increase may be produced in many cases.

On the one hand, it has been known that development speed is greatly influenced by the configurations, sizes, and compositions of the silver halide grains of a silver halide emulsion used in a light-sensitive material. It has been proved that the influence of a silver halide composition is particularly great and, when using a highly chloride-containing silver halide, a remarkably high development-speed may be shown.

On the other hand, for the purpose of absorbing the rays of light having a specific wavelength, coloring of a hydrophilic colloidal layer has been carried out by making use of a dye so as to work as a filter, to prevent halation and/or irradiation, or to control the sensitivity of a photographic emulsion. Further, for the purpose of improving image-sharpness, preventing of halation and/or irradiation has also been carried out.

The dyes used for such a purpose as mentioned above should satisfy the following various requirements; they should have excellent spectral absorption characteristics to meet the purpose of application; they should completely be decolored in a photographic processing solution and should readily flow out of a light-sensitive material so as not to produce any residual color contamination after the completion of treatment; any spectrally sensitized photographic emulsion should be neither sensitized nor desensitized or should not be affected by fog or the like; and they should have an excellent stability on standing and neither discoloration nor color-fading in a solution or a light-sensitive material.

Heretofore, there have been many proposals for a large number of dyes with great efforts for the purpose of discovering the dyes satisfying the above-given requirements. They include, for example, oxonol dyes disclosed in U.S. Pat. No. 3,247,127, and Japanese Patent Examined Publication No. 43-13168(1968); styryl dyes typically disclosed in U.S. Pat. No. 1,845,404; melocyanine dyes typically disclosed in U.S. Pat. Nos. 2,493,747, 3,148,187, and 3,282,699; cyanine dyes typically disclosed in U.S. Pat. No. 2,843,486; and anthraquinone dyes typically disclosed in U.S. Pat. No. 2,865,752.

Among the dyes given above, oxanol dyes having two skeletal pyrazolone have been used as the useful dyes, because they may be decolored in a photographic processing solution and may readily flow out of a light-sensitive material in character and, further, any photographic emulsion may not be so affected by them.

It was found that most of the oxonol dyes may have no problem when the silver halide composition of a spectrally sensitized silver halide emulsion in a light-sensitive material is a highly bromide-containing silver halide. However, it was also found that, when using a highly chloride-containing silver halide, there may be the defects such as a further sensitization of a spectrally sensitized silver halide emulsion to an undesired spectral region, a fog increase, or a serious variation in sensitivity and the like produced by a temperature or humidity change.

Among the above-mentioned defects, in the case of the spectral sensitization to an undesired spectral region, for example, a color balance may not well be obtained in printing operation, so that a desired image quality may not be obtained. In the case of fog increase, it may be presumed that this defect may be caused by making a dye which has flowed out or a decolored dye or the decomposed matter thereof active to a light-sensitive material in a processing solution, so that a white background may be deteriorated. In the case of serious variations of sensitivity or the like cause by a temperature or humidity change, there may be raised a serious problem that a constant quality may not be obtained because of the differences in the temperature and humidity controls and storage conditions followed by various photofinishing laboratories.

The above-mentioned defects are peculiar to the case of using a silver halide emulsion having a high silver chloride content. However, such a silver halide having a high silver chloride content is still essential to perform a rapid-processing. It has therefore difficult to obtain a silver halide photographic light-sensitive material capable of keeping a high image quality stable even in a rapid processing.

SUMMARY OF THE INVENTION

It is an object of the invention to provide a silver halide photographic light-sensitive material to which a rapid processing can suitably be applied, into which a dye inert to a spectrally sensitized photographic emulsion can be contained, to which a stability against a change of temperature and humidity and a processing stability can be provided, and in which a high image quality can be maintained.

Another object of the invention is to provide a silver halide photographic light-sensitive material containing a dye excellent in flow-out and decoloration properties The above-mentioned objects of the invention can be achieved with a silver halide photographic light-sensitive material comprising a support bearing at least one silver halide emulsion year, wherein at least one of the silver halide emulsion layers contains silver chlorobromide grains having a silver chloride content of not less than 90 mol% and a silver bromide content of not less than 0.05 mol%, and a compound represented by the following Formula I.

Formula (I)

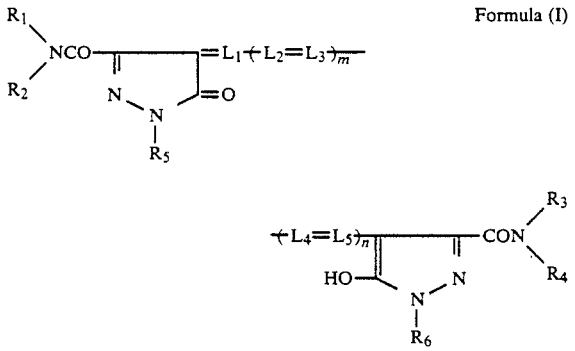

wherein $R_1$, $R_2$, $R_3$, $R_4$, $R_5$, and $R_6$ each represents a hydrogen atom, an alkyl group, an aryl group, an alkenyl group, or a heterocyclic group, provided that $R_1$ and $R_2$ are not a hydrogen atom at the same time and provided that $R_3$ and $R_4$ are not a hydrogen atom at the same time. The above-given alkyl group, aryl group, alkenyl group and heterocyclic group each may be either substituted or non-substituted. However, at least one of $R_1$, $R_2$, $R_3$, $R_4$, $R_5$, and $R_6$ is a group having a water-soluble group or a group having a substituent having a water-soluble group. $L_1$, $L_2$, $L_3$, $L_4$, and $L_5$ each represents a methine group, and m and n each is an integer of 0 or 1.

DETAILED DESCRIPTION OF THE INVENTION

In the invention, at least one of the silver halide emulsion layers contains silver halide grains having a silver chloride content of not less than 90 mol% and a silver bromide content of not less than 0.05% mol%.

In the silver grains of the invention, the silver chloride content thereof is preferably not less than 95 mol%, and the silver bromide content thereof is preferably within the range of 0.1 and 2 mol%.

Such silver halide grains of the invention may be used independently or in combination with other silver halide grains having compositions different from those of such grains.

In the silver halide emulsion layer of the invention containing silver halide grains having a silver chloride content of not less than 90 mol% and a silver bromide content of not less than 0.05 mol%, such emulsion layer contains silver halide grains having the above-mentioned silver chloride and silver bromide contents in a proportion of not less than 80% by weight and, more preferably, not less than 90% by weight of the total silver halide grains thereof.

The silver halide grains applicable to the silver halide emulsions of the invention are allowed to have either regular crystal forms or irregular crystal forms such as a spherical or tabular form. To these grains, any ratios of {100} face to {111} face may be applied.

In the silver halide grains applicable to the emulsions of the invention, a latent image may be formed mainly either on the surfaces of the grains or inside the grains.

The emulsions of the invention are to be chemically sensitized in an ordinary method.

To be more precise, such emulsions may be chemically sensitized in a sulfur-sensitization method in which a compound containing sulfur capable of reacting with silver ions such as active gelatin is used; in a selenium-sensitization method in which a selenium compound is used; a reduction-sensitization method in which a reducible matter is used; in a noble-metal sensitization method in which gold or other noble metal compounds are used; or in the sensitization method in combination with the above-given methods.

The emulsions of the invention may be spectrally sensitized to a desired wavelength region by making use of the dyes which have been well know in the photographic industry, as the sensitizing dyes. Such sensitizing dyes may be used independently or in combination.

Such emulsions are also allowed to contain, as well as the above-mentioned sensitizing dyes, a super-sensitizer which is a dye having no spectral sensitizing function in itself or a compound substantially incapable of absorbing any visible rays of light, each or which capable of enhancing the sensitizing functions of the sensitizing dyes.

Silver halide grains applicable to an emulsion layer which is other than the silver halide emulsion layers relating to the invention should preferable be the same grains applicable to the silver halide emulsion layers relating to the invention having a silver chloride content of not less than 90 mol% and a silver bromide content of not less than 0.05 mol%, and the proportion of the silver halide grains having a silver chloride content of not less than 90 mol% and a silver bromide content of not less than 0.05 mol% should preferably be not less than 90% by weight of the total silver halide grains of the emulsion layer.

In the silver halide photographic light-sensitive materials of the invention, a compound represented by the following Formula I is contained in at least one of the photographic component layers thereof, namely, the silver halide emulsion layers containing the silver halide grains of the invention, the light-sensitive layers including other silver halide emulsion layers than the above layers, and the non-light-sensitive layers such as an interlayer, a protective layer, a filter layer, and an antihalation layer.

The compounds relating to the invention represented by the formula I (hereinafter referred to as the dye of the invention) will now be detailed.

Formula (I)

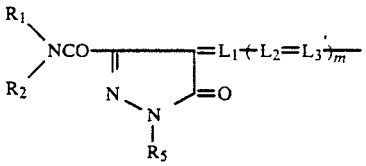

-continued

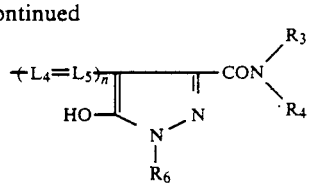

In the above-given formula I, $R_1$, $R_2$, $R_3$, $R_4$, T5, and $R_6$ each represent a hydrogen atom, a substituted or non-substituted alkyl group, a substituted or non-substituted aryl group, a substituted or non-substituted alkenyl group, or a substituted or non-substituted heterocyclic group, provided that $R_1$ and $R_2$ are not a hydrogen atom at the same time, and provided that $R_3$ and $R_4$ are not a hydrogen atom at the same time, and at least one of $R_1$ through $R_6$ is a group having a water-soluble group or a group having a substituent having a water-soluble group.

Alkyl groups represented by $R_1$ through $R_6$ include, for example, methyl, ethyl, propyl, isopropyl, butyl and t-butyl. Each of these alkyl groups may be substituted with hydroxyl, sulfo, carboxyl, halogen such as fluorine, chlorine, or bromine, alkoxy such as methoxy or ethoxy, aryloxy such as phenoxy, 4-sulfophenoxy, or 2,4-disulfophenoxy, aryl such as phenyl, 4-sulfophenyl, or 2,5-disulfophenyl, alkoxycarbonyl such as methoxycarbonyl, or ethoxycarbonyl, or aryloxycarbonyl such as phenoxycarbonyl.

The aryl groups represented by $R_1$ through $R_6$ include, for example, phenyl, 2-methoxyphenyl, 4-nitrophenyl, 3-chlorophenyl, 4-cyanophenyl, 4-hydroxyphenyl, 4-methanesulfonylphenyl, 4-sulfophenyl, 3-sulfophenyl, 2-methyl-4-sulfophenyl, 2-chloro-4-sulfophenyl, 4-cholor-3-sulfopheny, 2-chloro-5-sulfophenyl, 2-methoxy-5-sulfophenyl, 2-hydroxy-4-sulfophenyl, 2,5-dichloro-4-sulfophenyl, 2,6-diethyl-4-sulfophenyl, 2,5-disulfophenyl, 3,5-disulfophenyl, 2,4-disulfophenyl, 4-phenoxy-3-sulfophenyl, 2-chloro-6-methyl-4-sulfophenyl, 3-carboxy-2-hydroxy-5-sulfophenyl, 4-carboxyphenyl, 2,5-dicarboxyphenyl, 3,5-dicarboxyphenyl, 2,4-dicarboxyphenyl, 3,6-disulfo-α-naphthyl, hydroxy-3,6-disulfo-α-naphthyl, 5-hydroxy-7-sulfo-β-naphthyl, and 6,8-disulfo-β- naphthyl.

The alkenyl groups represented by $R_1$ through $R_6$ include, for example, vinyl, and allyl.

The heterocyclic groups represented by $R_1$ through $R_6$ include, for example, pyridyl such as 2-pyridyl, 3-pyridyl, 4-pyridyl, 5-sulfo-2-pyridyl, 5-carboxy-2-pyridyl, 3,5-dichloro-2-pyridyl, 4,6-dimethyl-2-pyridyl, 6-hydroxy-2-pyridyl, 2,3,5,6-tetrafluoro-4-pyridyl, and 3-nitro-2-pyridyl, oxazolyl such as 5-sulfo-2-benzooxazolyl, 2-benzooxazolyl, and 2-oxazolyl, thiazolyl such as 5-sulfo-2-benzothiazolyl, 2-benzothiazolyl, and 2-thiazolyl, imidazolyl such as 1-methyl-2-imidazolyl, and 1-methyl-5-sulfo-2-benzoimidazolyl, furyl such as 3-furyl, pyrrolyl such as 3-pyrrolyl, thienyl such as 2-thienyl, pyrazinyl such as 2-pyrazinyl, pyrimidinyl such as 2-pyrimidinyl, and 4-chloro-2-pyrimidinyl, pyridazinyl such as 2-pyridazinyl, purinyl such as 8-purinyl, isooxazolinyl such as 3-isooxazolinyl, selenazolyl such as 5-sulfo-2-selenazolyl, sulfuranyl such as 3-sulfuranyl, piperidinyl such as 1-methyl-3-piperidinyl, pyrazolyl such as 3-pyrazolyl, and tetrazolyl such as 1-tetrazolyl group. $R_1$, and $R_2$, or $R_3$ and $R_4$ may complete a ring, such as piperazyl ring, a piperidyl ring, and a morpholyl ring.

The groups represented by $R_5$ and $R_6$ include, preferably, alkyl groups, aryl groups and heterocyclic groups, more preferably, the alkyl groups, the aryl groups each having one or more water-soluble groups, and the heterocyclic groups and, particularly, the alkyl groups.

Such a water-soluble group as mentioned above include, for example, sulfo and the salt thereof, carboxyl and the salt thereof, hydroxyl, sulfuric acid ester, phosphinyl, phosphono, and phosphoryl.

In the above formula I, $L_1$, $L_2$, $L_3$, $L_4$ and $L_5$ each represents methine or unsubstituted methine. The substituents or the substituted methine groups are preferably lower alkyl such as methyl and ethyl.

The dyes of the invention represented by Formula I will be typically given below and it is to be understood that the dyes of the invention shall not be limited thereto.

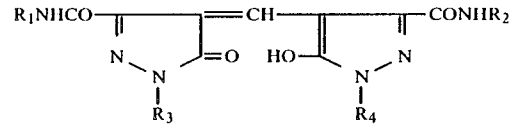
| No. | $R_1$ | $R_2$ | L | $R_3$ | $R_4$ |
|---|---|---|---|---|---|
| 1 | 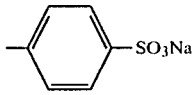 | 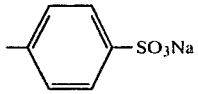 | | 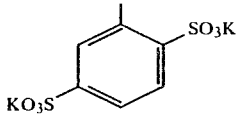 | 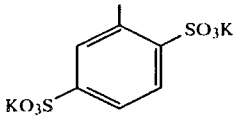 |
| 2 | 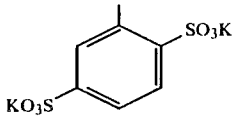 | 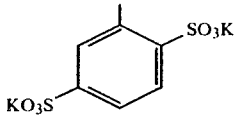 | | $-CH_3$ | $-CH_3$ |
| 3 | 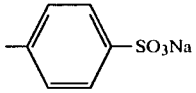 | 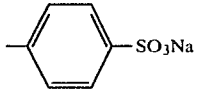 | | $-CH_3$ | $-CH_3$ |
| 4 | 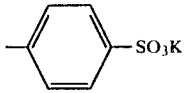 | 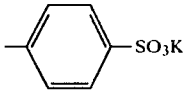 | | $-(CH_2)_2SO_3K$ | $-(CH_2)_2SO_3K$ |
| 5 | 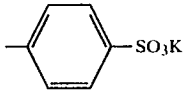 | 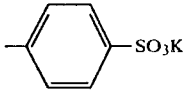 | | $-(CH_2)_2OH$ | $-(CH_2)_2OH$ |
| 6 | 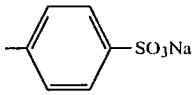 | 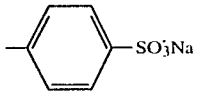 | | 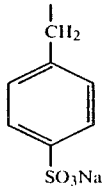 | 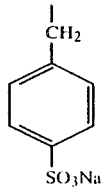 |

-continued
| No. | $R_1$ | $R_2$ | L | $R_3$ | $R_4$ |
|---|---|---|---|---|---|
| 7 | 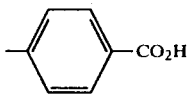 | 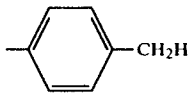 | | $-CH_3$ | $-CH_3$ |
| 8 | $-CH_3$ | $-CH_3$ | | 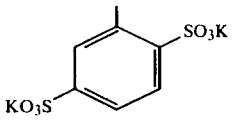 | 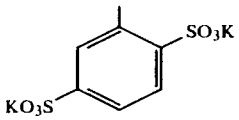 |
| 9 | 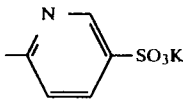 | 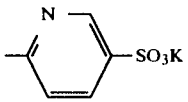 | | $-CH_3$ | $-CH_3$ |
| 10 | 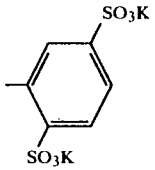 | 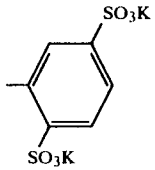 | | $-C_2H_5$ | $-C_2H_5$ |
| 11 | 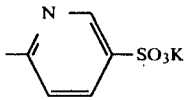 | 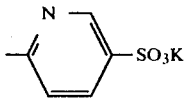 | | $-C_2H_5$ | $-C_2H_5$ |
| | 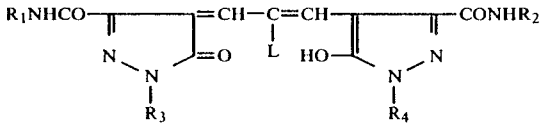 | | | | |
| 12 | 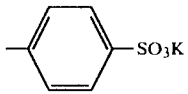 | 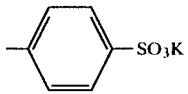 | H | 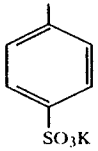 | 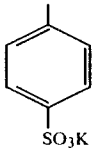 |

-continued
| No. | $R_1$ | $R_2$ | L | $R_3$ | $R_4$ |
|---|---|---|---|---|---|
| 13 | 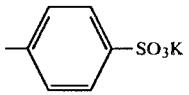 | 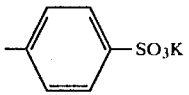 | H | 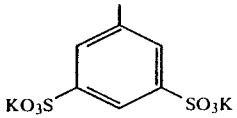 | 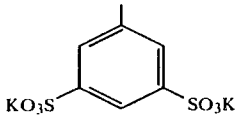 |
| 14 | 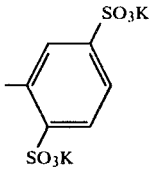 | 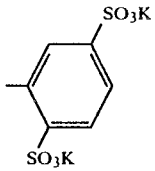 | H | $-CH_3$ | $-CH_3$ |
| 15 | 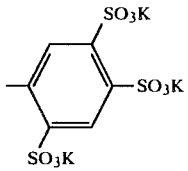 | 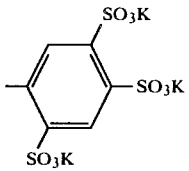 | H | $-CH_3$ | $-CH_3$ |
| 16 | 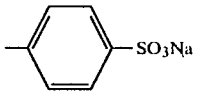 | 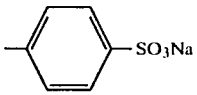 | H | $-(CH_2)_2OCH_3$ | $-(CH_2)_2OCH_3$ |
| 17 | 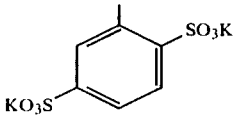 | 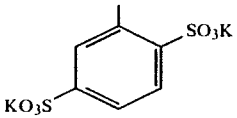 | H | 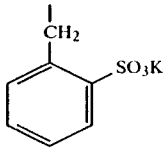 | 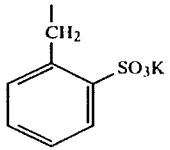 |
| 18 | 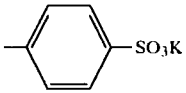 | 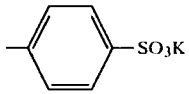 | H | $-C_2H_5$ | $-C_2H_5$ |

-continued
| No. | $R_1$ | $R_2$ | L | $R_3$ | $R_4$ |
|---|---|---|---|---|---|
| 19 | 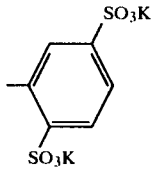 | 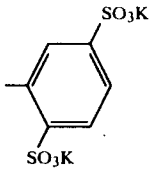 | H | $-CH_2CH{=}CHBr$ | $-CH_2CH{=}CHBr$ |
| 20 | 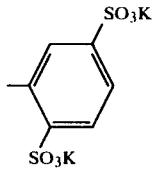 | 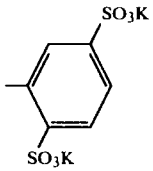 | H | 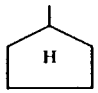 | 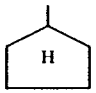 |
| 21 | 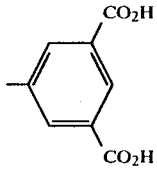 | 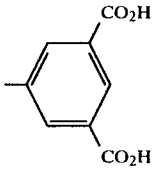 | H | $-CH_3$ | $-CH_3$ |
| 22 | 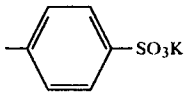 | 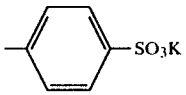 | H | 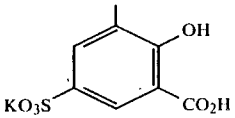 | 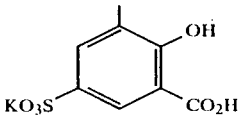 |
| 23 | 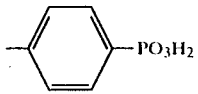 | 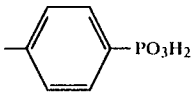 | H | 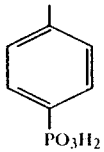 | 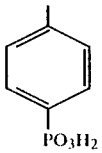 |
| 24 | $-(CH_2)_2SO_3K$ | $-(CH_2)_2SO_3K$ | H | $-CH_3$ | $-CH_3$ |

-continued
| No. | $R_1$ | $R_2$ | L | $R_3$ | $R_4$ |
|---|---|---|---|---|---|
| 25 | $-(CH_2)_2OH$ | $-(CH_2)_2OH$ | H | 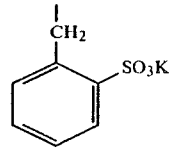 | 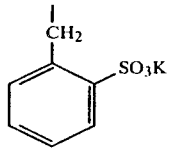 |
| 26 | $-(CH_2)_2OH$ | $-(CH_2)_2OH$ | H | 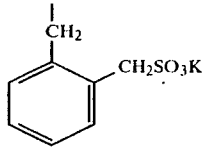 | 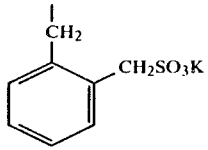 |
| 27 | $-(CH_2)_2OH$ | $-(CH_2)_2OH$ | H | 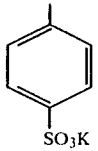 | 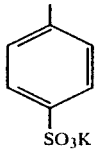 |
| 28 | 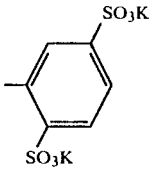 | 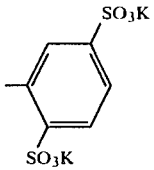 | H | H | H |
| 29 | 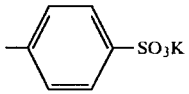 | 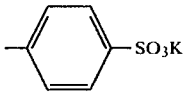 | H | H | H |
| 30 | 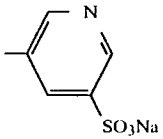 | 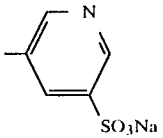 | H | $-CH_3$ | $-CH_3$ |

-continued
| No. | $R_1$ | $R_2$ | L | $R_3$ | $R_4$ |
|---|---|---|---|---|---|
| 31 | 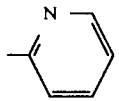 | 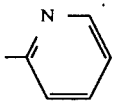 | H | 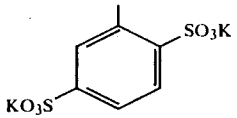 | 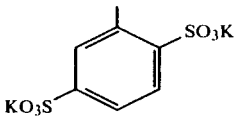 |
| 32 | 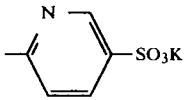 | 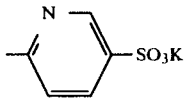 | H | 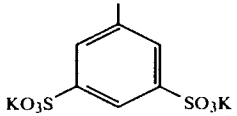 | 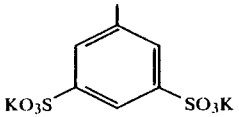 |
| 33 | 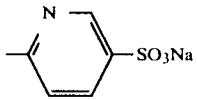 | 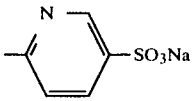 | H | 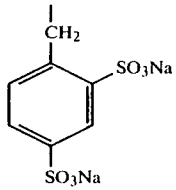 | 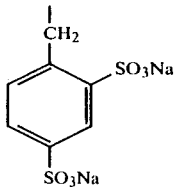 |
| 34 | 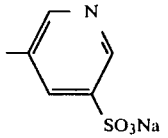 | 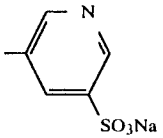 | H | 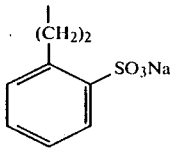 | 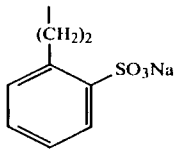 |
| 35 | 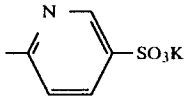 | 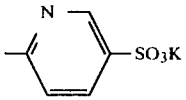 | H | $-CH_2CH=CH_2$ | $-CH_2CH=CH_2H$ |
| 36 | 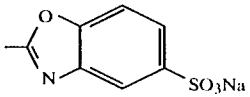 | 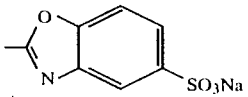 | H | 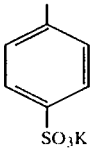 | 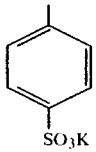 |

-continued
| No. | $R_1$ | $R_2$ | L | $R_3$ | $R_4$ |
|---|---|---|---|---|---|
| 37 | 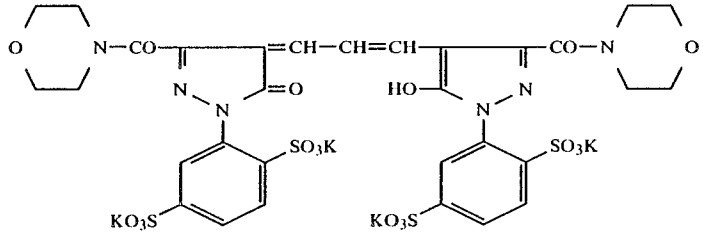 | | | | |
| 38 | 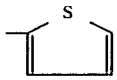 | 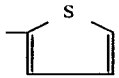 | H | $-(CH_2)_2SO_3Na$ | $-(CH_2)_2SO_3Na$ |
| 39 | 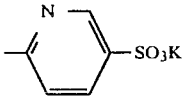 | 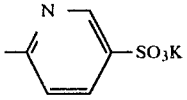 | H | 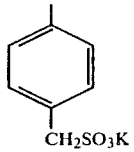 | 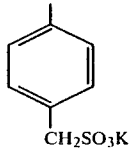 |
| 40 | 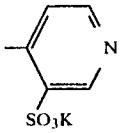 | 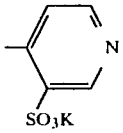 | H | $-C_4H_9(t)$ | $-C_4H_9(t)$ |
| 41 | 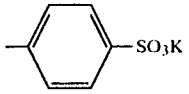 | 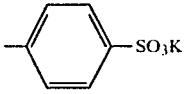 | H | 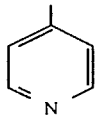 | 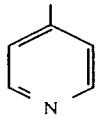 |
| 42 | 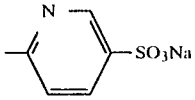 | 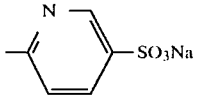 | H | 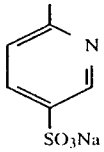 | 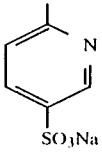 |

-continued
| No. | $R_1$ | $R_2$ | L | $R_3$ | $R_4$ |
|---|---|---|---|---|---|
| 43 | $-(CH_2)_2OH$ | $-(CH_2)_2OH$ | H | 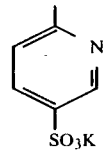 | 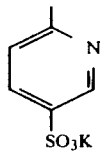 |
| 44 | 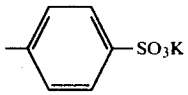 | 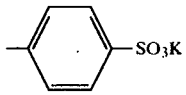 | H | 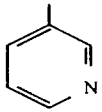 | 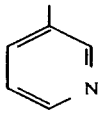 |
| 45 | $-CH_2CH{=}CH_2$ | $-CH_2CH{=}CH_2$ | H | 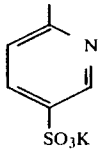 | 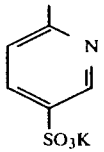 |
| 46 | 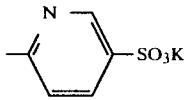 | 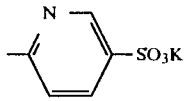 | H | $-CH_3$ | 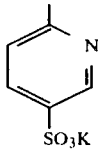 |
| 47 | 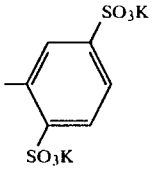 | 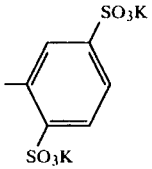 | H | $-C_2H_5$ | $-C_2H_5$ |
| 48 | 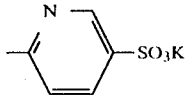 | 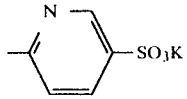 | H | $-C_2H_5$ | $-C_2H_5$ |

-continued
| No. | $R_1$ | $R_2$ | L | $R_3$ | $R_4$ |
|---|---|---|---|---|---|
| 48 | 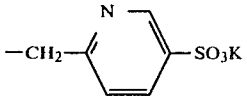 | 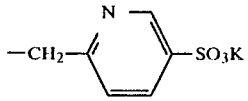 | H | $-C_2H_5$ | $-C_2H_5$ |
| 50 | 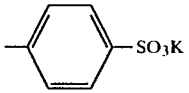 | 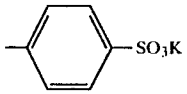 | $-CH_3$ | $-C_2H_5$ | $-C_2H_5$ |
| | 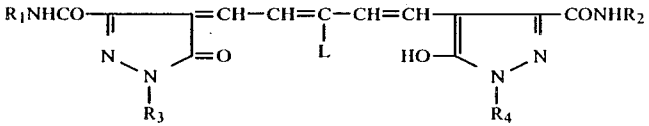 | | | | |
| 51 | 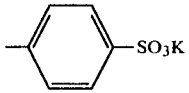 | 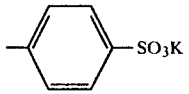 | H | 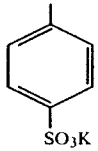 | 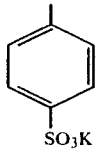 |
| 52 | 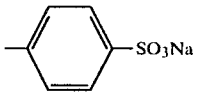 | 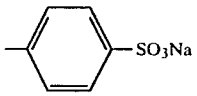 | H | 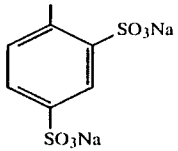 | 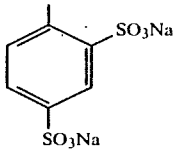 |
| 53 | 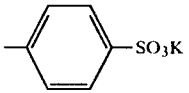 | 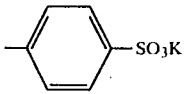 | H | $-CH_3$ | $-CH_3$ |
| 54 | 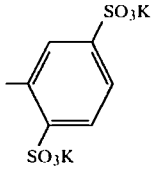 | 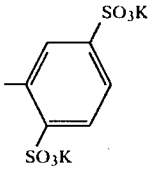 | H | $-CH_3$ | $-CH_3$ |

-continued
| No. | $R_1$ | $R_2$ | L | $R_3$ | $R_4$ |
|---|---|---|---|---|---|
| 55 | 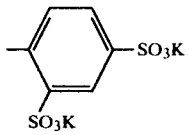 | 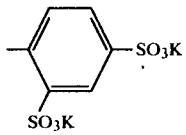 | H | $-CH_3$ | $-CH_3$ |
| 56 | 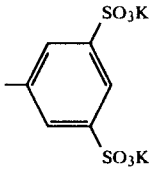 | 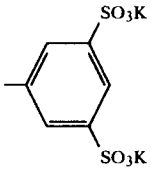 | H | $-CH_3$ | $-CH_3$ |
| 57 | 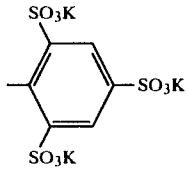 | 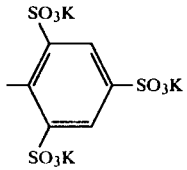 | H | $-CH_3$ | $-CH_3$ |
| 58 | 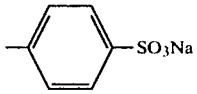 | 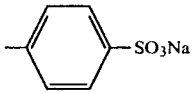 | H | $-(CH_2)_3SO_3Na$ | $-(CH_2)_3SO_3Na$ |
| 59 | 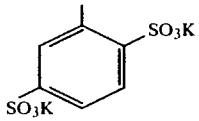 | 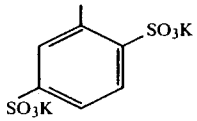 | H | 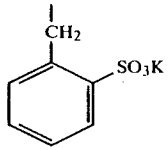 | 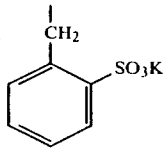 |
| 60 | 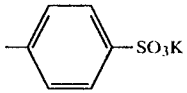 | 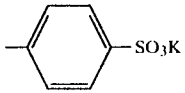 | H | 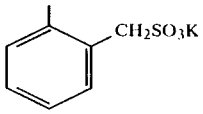 | 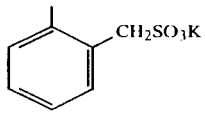 |

-continued
| No. | $R_1$ | $R_2$ | L | $R_3$ | $R_4$ |
|---|---|---|---|---|---|
| 61 | 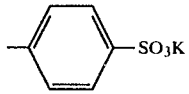 | 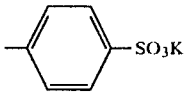 | H | 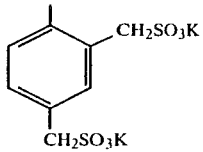 | 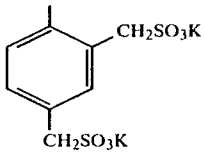 |
| 62 | 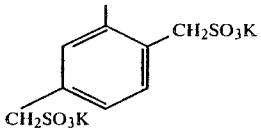 | 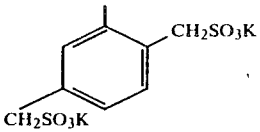 | H | 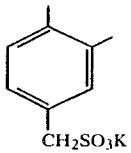 | 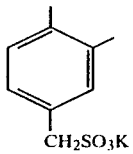 |
| 63 | 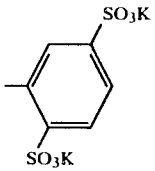 | 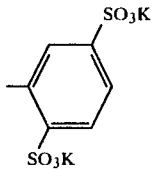 | H | $-C_3H_7(i)$ | $-C_3H_7(i)$ |
| 64 | 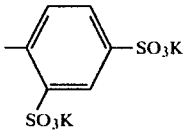 | 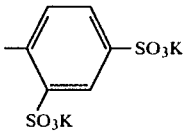 | H | $-C_4H_9(t)$ | $-C_4H_9(t)$ |
| 65 | 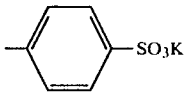 | 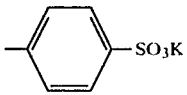 | H | $-CH_2CH(CH_3)SO_3K$ | $-CH_2CH(CH_3)SO_3K$ |
| 66 | 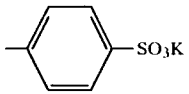 | 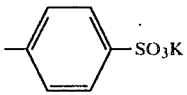 | H | $-(CH_2)_2CO_2H$ | $-(CH_2)_2CO_2H$ |
| 67 | 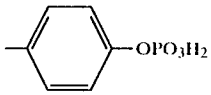 | 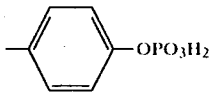 | H | $-CH_3$ | $-CH_3$ |

-continued
| No. | $R_1$ | $R_2$ | L | $R_3$ | $R_4$ |
|---|---|---|---|---|---|
| 68 | 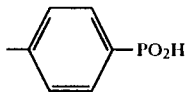 | 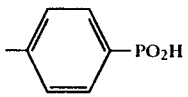 | H | $-(CH_2)_2OH$ | $-(CH_2)_2OH$ |
| 69 | 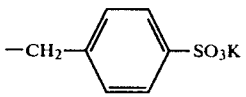 | 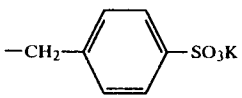 | H | $-CH_3$ | $-CH_3$ |
| 70 | $-(CH_2)_2OH$ | $-(CH_2)_2OH$ | H | 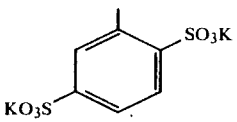 | 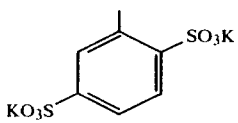 |
| 71 | 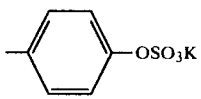 | 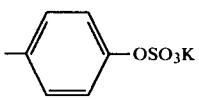 | H | $-CH_3$ | $-CH_3$ |
| 72 | 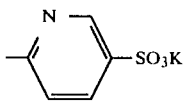 | 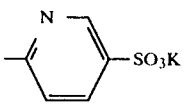 | H | $-CH_3$ | $-CH_3$ |
| 73 | 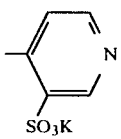 | 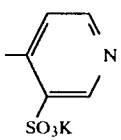 | H | $-CH_3$ | $-CH_3$ |
| 74 | 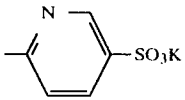 | 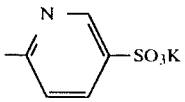 | H | $-(CH_2)_2SO_3K$ | $-(CH_2)_2SO_3K$ |

-continued
| No. | $R_1$ | $R_2$ | L | $R_3$ | $R_4$ |
|---|---|---|---|---|---|
| 75 | 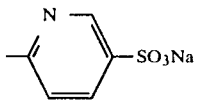 | 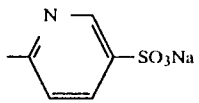 | H | 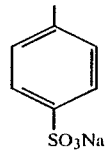 | 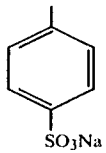 |
| 76 | 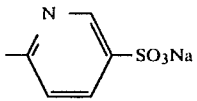 | 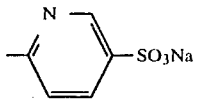 | H | $-C_2H_5$ | $-C_2H_5$ |
| 77 | 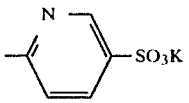 | 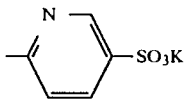 | H | 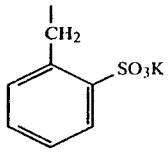 | 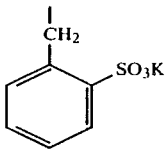 |
| 78 | 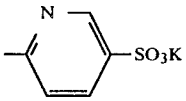 | 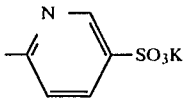 | $-CH_3$ | 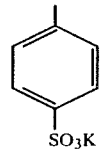 | 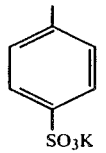 |
| 79 | 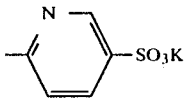 | 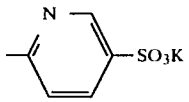 | H | 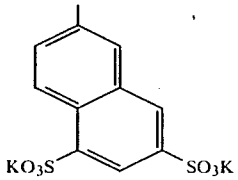 | 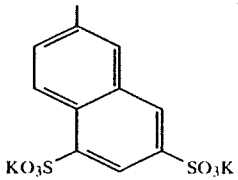 |
| 80 | 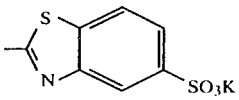 | 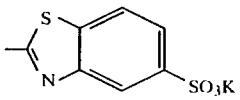 | H | $-CH_3$ | $-CH_3$ |

-continued
| No. | $R_1$ | $R_2$ | L | $R_3$ | $R_4$ |
|---|---|---|---|---|---|
| 81 | 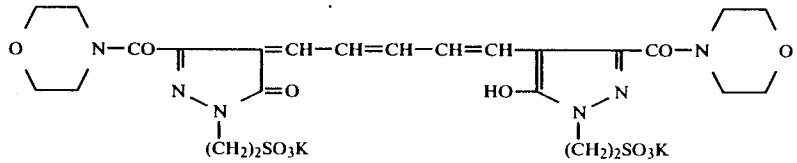 | | | | |
| 82 | 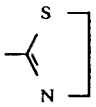 | 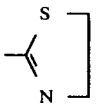 | H | $-(CH_2)_2SO_3K$ | $-(CH_2)_2SO_3K$ |
| 83 | 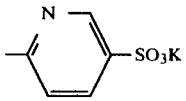 | 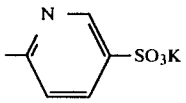 | H | 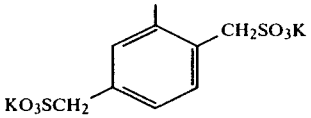 | 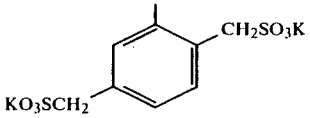 |
| 84 | 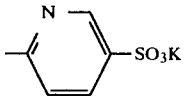 | 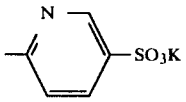 | H | $-C_3H_7(i)$ | $-C_3H_7(i)$ |
| 85 | 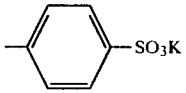 | 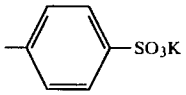 | H | 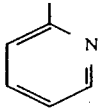 | 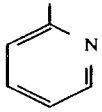 |
| 86 | 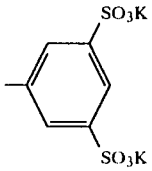 | 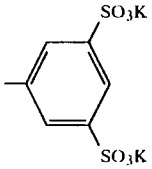 | H | 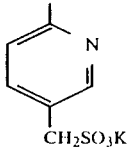 | 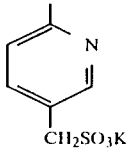 |

-continued
| No. | $R_1$ | $R_2$ | L | $R_3$ | $R_4$ |
|---|---|---|---|---|---|
| 87 | 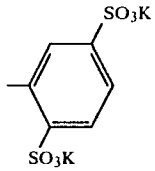 | 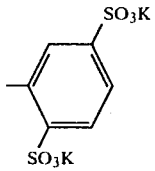 | H | 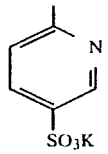 | 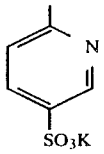 |
| 88 | 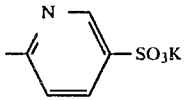 | 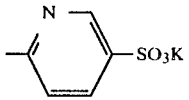 | H | 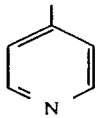 | 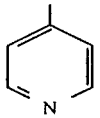 |
| 89 | 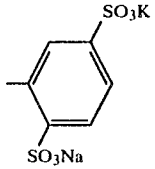 | 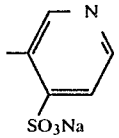 | H | $-CH_3$ | $-CH_3$ |
| 90 | 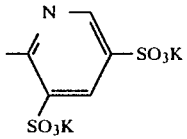 | 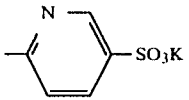 | H | $-CH_3$ | $-CH_3$ |
| 91 | 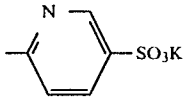 | 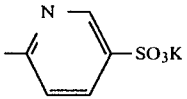 | H | 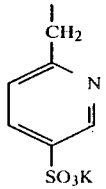 | 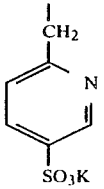 |
| 92 | 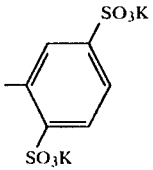 | 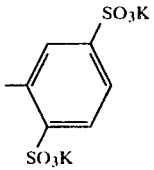 | H | $-C_2H_5$ | $-C_2H_5$ |

-continued
| No. | $R_1$ | $R_2$ | L | $R_3$ | $R_4$ |
|---|---|---|---|---|---|
| 93 | 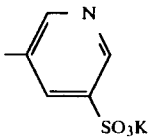 | 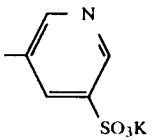 | H | $-C_2H_5$ | $-C_2H_5$ |
| 94 | 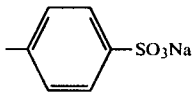 | 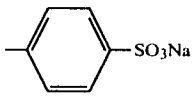 | H | $-C_3H_7(i)$ | $-C_3H_7(i)$ |
| 95 | 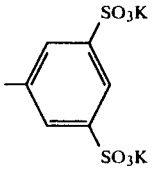 | 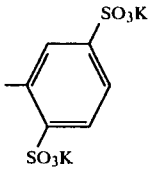 | H | $-C_4H_9(t)$ | $-C_4H_9(t)$ |
| 96 | 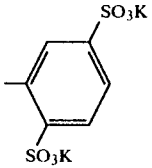 | 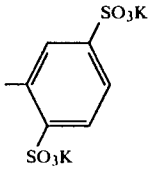 | H | $-C_3H_7$ | $-C_3H_7$ |
| 97 | 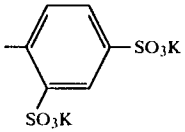 | 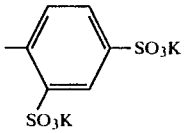 | H | $-CH_3$ | $-CH_3$ |
| 98 | 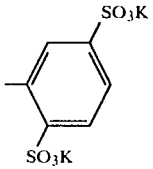 | 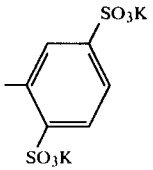 | $-CH_3$ | $-CH_3$ | $-CH_3$ |
| 99 | $-(CH_2)_2OH$ | $-(CH_2)_2OH$ | $-C_2H_5$ | $-(CH_2)_2SO_3K$ | $-(CH_2)_2SO_3K$ |

-continued
| No. | $R_1$ | $R_2$ | L | $R_3$ | $R_4$ |
|---|---|---|---|---|---|
| 100 | 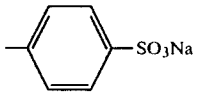 | 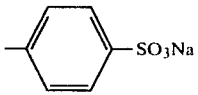 | $-CH_3$ | 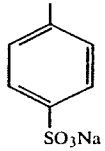 | 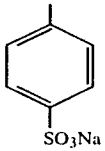 |
| 101 | 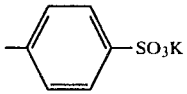 | 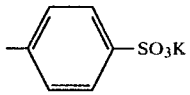 | $-CH_3$ | 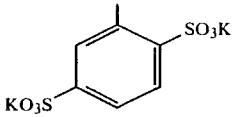 | 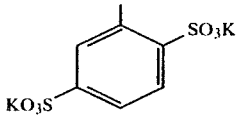 |
| 102 | 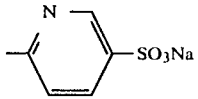 | 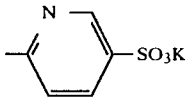 | $-CH_3$ | $-C_2H_5$ | $-C_2H_5$ |
| 103 | 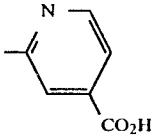 | 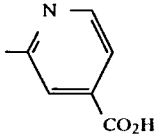 | H | 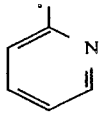 | 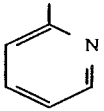 |

The above-mentioned dyes of the invention may readily be synthesized in the method described in Japanese Patent O.P.I. Publication No. 58-1433412 (1983). The initial raw-material for the synthesis, i.e., a 3-carboxy-5-pyrazolone derivative, may be synthesized in the methods described in, for example, Japanese Patent O.P.I. Publication No. 63-185934(1988); The Journal of The American Chemical Society, 71, 983(1949); and Chemische Berichte, 109, 253(1976). The typical schemes for the synthesis will be given below.

<Scheme 1>

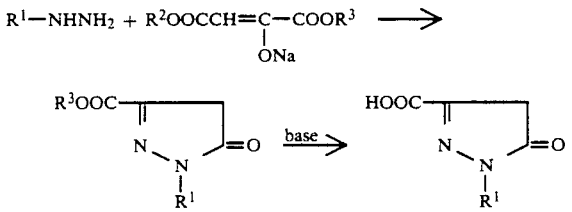

<Scheme 2>

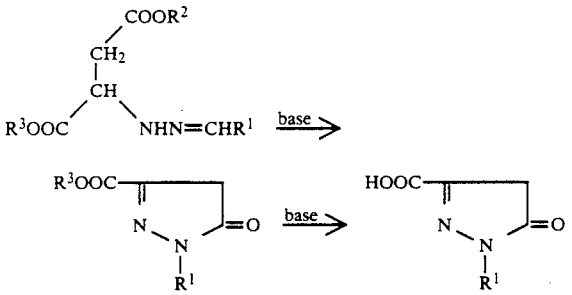

<Scheme 3>

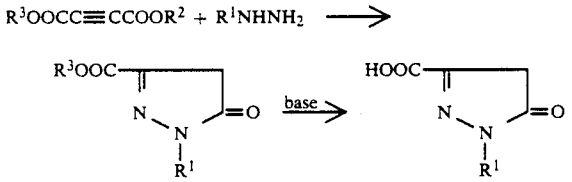

In the schemes above, $R^1$, $R^2$, and $R^3$ each represents alkyl, alkenyl, aryl or a heterocyclic group each of which may have a substituent. Among them, it is particularly preferable that $R^2$ and $R^3$ are each alkyl.

In the silver halide photographic light-sensitive materials of the invention, the dyes of the invention represented by the above-given Formula I may be added into either the silver halide emulsion layers of the invention or the other silver halide emulsion layers so as to serve as an antirradiation dye, or they may also be added into a non-light-sensitive hydrophilic colloidal layer to serve as either a filter dye or an antihalation dye. When adding the dye of the invention into a silver halide emulsion layer, it is preferable that a compound represented by Formula I having m=0 and n=0 should be added into a blue-sensitive silver halide emulsion layer; a compound having m=1 and n=0, into a green-sensitive emulsion layer; and a compound having m=1 and n=1, into a red-sensitive emulsion layer; respectively.

Despite the above, if a dye has property to diffuse from one layer into the other and it is added into a layer other than the emulsion layers, such as a protective layer or an interlayer, the same effects as those obtainable when it is added directly into the emulsion layers may be obtained, because the dye diffuses into the emulsion layers.

It is also allowed to use two or more kinds of such dyes or to use with other dyes in combination, so as to meet the purpose of the use.

The dyes of the invention can be contained in a silver halide photographic light-sensitive layer or other hydrophilic colloidal layers usually in such a manner that the dye or the organic or inorganic alkali salts thereof are dissolved in an aqueous solution or an organic solvent such as those of alcohols, glycols, cellosolves, diethylformaldehyde, dibutyl phthalate or tricresyl phosphate, upon dispersion-emulsification thereof if required, and the resulting solution is added into a coating solution, so that the dye is contained in the light-sensitive material by applying the coating solution to the light-sensitive material.

There is no special limitation to the content of the dyes of the invention, but the content thereof may be varied to meet the purposes of the use. Such dyes are added in an amount within the range of, usually, 0.01 to 2.0 mg/dm$^2$ and, more preferably, 0.03 to 1.0 mg/dm$^2$.

In the coated layers of each component layer of the silver halide photographic light-sensitive material of the invention, a fluorescent brightening agent scavenger should preferably be added so as to control the absorption maximum wavelength of a dye which is excellent in decoloration.

It is preferable that such fluorescent brightening agent scavenger should present in the same layer as that containing the dye of the invention. In the case that such dye is of the diffusion type, it is, however, allowed that, after the scavenger is added into the coating solution which is to be applied to a layer other than the containing the dye, the resulting scavenger-containing coating solution, is coated on said other layer, and the dye diffuses into the scavenger-containing layer, before the other layer is dried.

Any compounds may be used for such a scavenger as mentioned above, provided that the compound is capable of scavenging fluorescent brightening agents. Among such compounds, the particularly useful compounds are hydrophilic polymers including, for example; a polyvinyl pyrrolidone or a copolymer containing vinyl pyrrolidone as its repetition unit; a hydrophilic polymer containing a cationic nitrogen-containing active group such as those described in Japanese Patent O.P.I. Publication No. 48-42732(1973); and a vinyl pyrrolidone copolymer such as those described in Japanese Patent Examined Publication No. 47-20738(1972).

Among these scavengers, a polyvinyl pyrrolidone or the copolymers thereof may preferably be used.

The scavengers applicable to the invention are usually used in a coating amount of within the range of 0.05 to 3.0 mg/dm$^2$.

For the purposes of preventing fogginess and/or keeping the stability of photographic characteristics of a light-sensitive material In the course of the preparation process, preservation, or photographic processing of the light-sensitive material, a compound well known in photographic industry as an antifoggant or a stabilizer may be added into the silver halide emulsions of the invention, in the course of carrying out a chemical ripening, after completing the chemical ripening, and/or in the course from the point of time when completing the chemical sensitization to the point of time when coating the silver halide emulsion.

As for the binders or the protective colloids of the silver halide emulsions of the invention, gelatin may advantageously be used and, in addition, hydrophilic colloids including, for example, a gelatin derivative, a graft-polymer of gelatin, a cellulose derivative, and synthetic hydrophilic high-molecular substances such as those of monomers or copolymers.

The silver halide photographic light-sensitive materials of the invention having the above-mentioned constitution may be used as a color-negative film, a color-positive film, or a color-printing paper, for example.

The silver halide photographic light-sensitive materials of the invention including the above-mentioned color-printing paper may be used for either monochromatic or multicolor photography. In the case of the silver halide photographic light-sensitive materials for multicolor photography, the emulsion layers thereof are applied with a dye-forming coupler capable of forming a dye upon coupling reaction with the oxidized productions of an aromatic primary amine developing agent in a color development process.

Yellow dye forming couplers include, for example, acylacetamide coupler. Magenta dye forming couplers include, for example, 5-pyrazolone coupler, pyrazolobenzimidazole coupler. pyrazolotriazole coupler and open-chained acylacetonitrile coupler. And, cyan dye forming couplers include, for example, naphthol coupler and phenol coupler.

It is desired that these dye forming couplers contain, in their molecules, the so-called ballast group having not less than 8 carbon atoms to inhibit couplers from diffusing.

Further, the silver halide photographic light-sensitive materials of the invention may arbitrarily contain additives including, for example, a hardener, a color contamination inhibitor, an image stabilizer, a UV absorbent, a plasticizer, a latex, a surfactant, a matting agent, a lubricant, and an antistatic agent.

The silver halide photographic light-sensitive materials of the invention may be processed in a color development process having been well known in the photographic industry, so that images may be formed.

In the invention, the color developing agents applicable to color developers include, for example, an aminophenol type or p-phenylenediamine type derivatives which are widely used in various color photographic processes.

To the color developers applicable to the treatment of the silver halide photographic light-sensitive materials of the invention, the compounds having the developer components which are already known, as well as the above-mentioned aromatic primary amine type color developing agents, may be added.

The pH values of such color developers are, usually, not less than 7 and, most preferably, within the range of approximately 10 to 13.

The color developing temperature is, usually, not lower than 15° C and, generally, within the range of 20 to 50° C. A rapid-processing should preferably be treated at a temperature of not lower than 30° C. In the invention, a color developing time for a rapid-processing is within the range of, generally, 20 to 60 seconds and, more preferably, 30 to 50 seconds.

After a silver halide photographic light-sensitive material of the invention is color-developed, it is bleached and then fixed. Such bleaching and fixing steps may be carried out at the same time.

After completing the fixing step, a washing step is usually carried out. It is also allowed to carry out a stabilizing step in place of the washing step, or to carry out the two steps together.

EXAMPLES

The invention will now be detained with reference to the following examples. It is, however, to be understood that the embodiments of the invention shall not be limited thereto.

Example 1

The following silver chlorobromide emulsion and silver chloride emulsion were prepared in a double-jet precipitation method.

| Emulsion | Silver chloride content (mol %) | Silver bromide content (mol %) |
|---|---|---|
| Em-A | 50 | 50 |
| Em-B | 70 | 30 |
| Em-C | 90 | 10 |
| Em-D | 99 | 1 |
| Em-E | 99.7 | 0.3 |
| Em-F | 100 | 0 |

The above-mentioned Em-A through Em-F were chemically sensitized in an ordinary method by making use of chlorauric acid in a mount of $5\times10^{-6}$ mol/mol AgX and sodium thio-sulfate in an amount of 2 mg/mol AgX in combination, and were further spectrally sensitized with the following sensitizing dye SDC-1, so that red-sensitive silver halide emulsions Em R-A through Em R-F were prepared.

Each of the coating solutions for the following layers 1 and 2 was simultaneously multicoated on a polyethylene-laminated paper support, so that the light-sensitive materials for monochromatic photographic use 1—1 through 1—23 were prepared. In the layers, the amounts of the components added to the coating solution are each shown in terms of an amount added per 100 $cm^2$ in the case that each layer is singled-coated.

Layer 1 . . . A red-sensitive silver halide emulsion layer contained a red-sensitive silver halide emulsion shown in Table-1 in an amount of 3 mg in terms of silver content, 2 mg of cyan coupler C-1, 3 mg of dioctyl phthalate to serve as a high boiling organic solvent, 0.15 mg of the following hydroquinone derivative HQ-1, 14 mg of gelatin, and 2 mg of the following inhibitor S-1.

Lay 2 . . . A protective layer containing 0.1 mg of the compound represented by Formula I which is shown in Table 1, or 0.1 mg each of the following dyes AI-1, AI-2 and AI-3, to serve as the control compounds, 0.25 mg of polyvinyl pyrolidone having a weight-average molecular weight of 360,000 to serve as a fluorescent brightening agent scavenger, 20 mg of gelatin, and 0.1 mg of the following hardener H-1.

On the other hand, Sample I-24 was prepared in the same manner as in Sample I-14, except that polyvinyl pyrrolidone was not added.

C-1
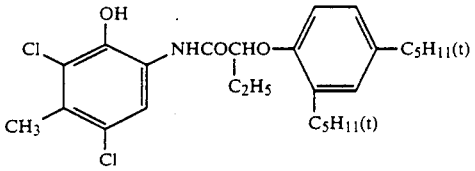
HQ-1
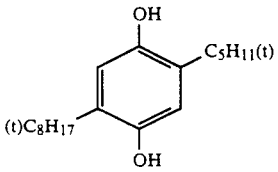
S-1
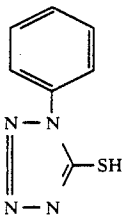
H-1
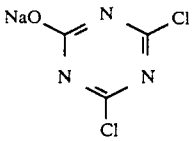
AI-1
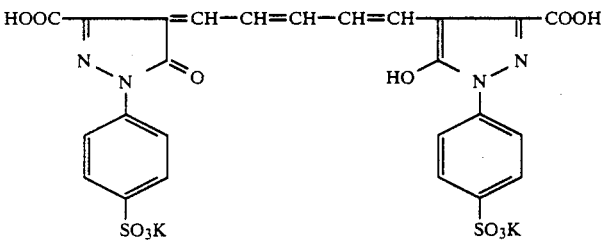
AI-2
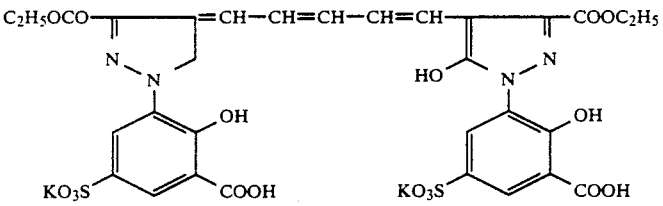
AI-3
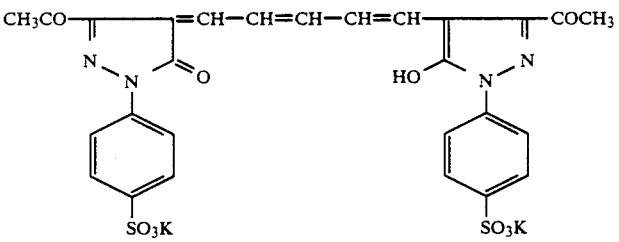

-continued

SDC-1

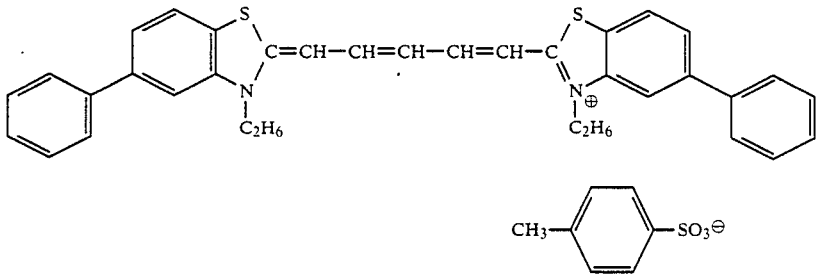

After thus prepared samples were exposed to light through a wedge by means of a photosensitometer, KS-7 manufactured by Konica Corporation, or as they remained unexposed to light, they were then subject to the following processing treatments.

| Processing Step | Temperature | Time |
|---|---|---|
| Color developing | 35.0 + 0.3° C. | 45 sec. |
| Bleach-fixing | 35.0 + 0.5° C. | 45 sec. |
| Stabilizing | 30 to 34° C. | 90 sec. |
| Drying | 60 to 80° C. | 60 sec. |
| Color Developer | | |
| Pure water | 800 ml | |
| Triethanolamine | 10 g | |
| N,N-diethylhydroxylamine | 5 g | |
| Potassium bromide | 0.02 g | |
| Potassium chloride | 2 g | |
| Potassium sulfite | 0.3 g | |
| 1-hydroxyethylidene-1,1-diphosphoric acid | 1.0 g | |
| Ethylenediaminetetraacetic acid | 1.0 g | |
| Disodium catech-3, 5-disulfonate | 1.0 g | |
| N-ethyl-N-β-methanesulfonamidoethyl-3-methyl-4-aminoaniline sulfate | 4.5 g | |
| Fluorescent brightening agent, (4,4'-diaminostilbene disulfonic acid) | 1.0 g | |
| Potassium carbonate | 27 g | |
| Add water to make in total of | 1 liter | |
| Adjust pH with potassium hydroxide or sulfuric acid to | pH = 10.10 | |
| Bleach-Fixer | | |
| Ferric ammonium ethylenediamine tetraacetate, dihydrate | 60 g | |
| Ethylenediaminetetraacetic acid | 3 g | |
| Ammonium thiosulfate, (in a 70% aqueous solution) | 100 ml | |
| Ammonium sulfite, (in a 40% aqueous solution) | 27.5 ml | |
| Add water to make | 1 liter | |
| Adjust pH with potassium carbonate or glacial acetic acid to | pH = 6.2 | |
| Stabilizer | | |
| 5-chloro-2-methyl-4 isothiazoline-3-one | 1.0 g | |
| Ethyleneglycol | 1.0 g | |
| 1-hydroxyethylidene-1,1-diphosphoric acid | 2.0 g | |
| Ethylenediaminetetraacetic acid | 1.0 g | |
| Ammonium hydroxide, (in a 20% aqueous solution) | 3.0 g | |
| Ammonium sulfite | 3.0 g | |
| Fluorescent brightening agent, (4,4'-diaminostilbene disulfonic acid) | 1.5 g | |
| Add water to make | 1 liter | |
| Adjust pH with sulfuric acid or potassium hydroxide to | pH = 7.0 | |

With respect to the samples thus treated, the following characteristic values were obtained.

1 Sensitometry : The sensitivity, gradient and maximum density Dmax of the treated samples were obtained by a densitometer, PDS-65 manufactured by Konica Corp. The sensitivity is expressed in relation to that of Sample 1—1 which is regarded as a value of 100.

2 Fog : The samples were treated as they remained unexposed to light in the above-mentioned manner and the reflection density of each treated sample was measured by a 310TR manufactured by X Light Company.

3Sharpness : A resolving power test chart was printed on the samples through red light and the samples were treated as mentioned above. The resulting cyan image density of each sample was measured by a microphotometer. The sharpness is expressed in a value obtained by the following formula.

$$\text{Sharpness (\%)} = \frac{\langle\text{Maximum density} - \text{Minimum density}\rangle \text{ of a close-set 5-line/mm line printed image}}{\langle\text{Maximum density} - \text{Minimum density}\rangle \text{ in a large area}} \times 100$$

It is indicated that the higher the values, the better the sharpness.

The results thereof are shown in Table-1.

TABLE 1

| Sample No. | Em No. Em R- | Dye | Sensitometry Relative sensitivity | Dmax | Fog | Sharpness |
|---|---|---|---|---|---|---|
| I-1 | A | AI-1 | 100 | 2.13 | 0.016 | 0.49 |
| I-2 | B | AI-1 | 106 | 2.10 | 0.017 | 0.48 |
| I-3 | B | 51 | 107 | 2.20 | 0.017 | 0.53 |
| I-4 | C | AI-1 | 118 | 2.53 | 0.021 | 0.48 |
| I-5 | C | 58 | 117 | 2.54 | 0.019 | 0.54 |
| I-6 | D | AI-2 | 120 | 2.54 | 0.026 | 0.54 |
| I-7 | D | AI-3 | 119 | 2.53 | 0.025 | 0.54 |
| I-8 | D | 59 | 121 | 2.54 | 0.018 | 0.55 |
| I-9 | E | AI-1 | 122 | 2.55 | 0.025 | 0.49 |
| I-10 | E | AI-2 | 124 | 2.56 | 0.028 | 0.55 |
| I-11 | E | AI-3 | 123 | 2.55 | 0.026 | 0.55 |
| I-12 | E | 52 | 124 | 2.56 | 0.019 | 0.56 |
| I-13 | E | 55 | 123 | 2.56 | 0.016 | 0.56 |
| I-14 | E | 57 | 124 | 2.56 | 0.017 | 0.56 |
| I-15 | E | 62 | 123 | 2.55 | 0.019 | 0.57 |
| I-16 | E | 63 | 124 | 2.56 | 0.016 | 0.56 |
| I-17 | E | 67 | 124 | 2.55 | 0.016 | 0.55 |
| I-18 | E | 74 | 123 | 2.56 | 0.015 | 0.57 |
| I-19 | E | 78 | 123 | 2.56 | 0.018 | 0.57 |
| I-20 | E | 102 | 124 | 2.56 | 0.015 | 0.57 |
| I-21 | F | AI-3 | 125 | 2.55 | 0.030 | 0.55 |
| I-22 | F | 70 | 125 | 2.56 | 0.021 | 0.56 |
| I-23 | F | 75 | 124 | 2.56 | 0.023 | 0.56 |
| I-24 | E | 57 | 124 | 2.56 | 0.017 | 0.51 |

From the results shown in Table-1, the following facts were found.

In Samples I-1 through I-3 each having used an emulsion having a low silver chloride content other than those of the invention, the-sensitivity and maximum density Dmax are not sufficient even if using comparative dyes or those of the invention.

In contrast to the above, in Samples I-4, I-6, I-7, I-9, I-10 and I-11 each of which have used the emulsion of the invention having a low silver chloride content and the comparative dye in combination, the fog level is unsatisfactorily high, though the sensitivity and maximum density may be improved. On the other hand, in Samples I-4 and I-9, the sharpness thereof are unsatisfactory.

that a blue-sensitive silver halide emulsion Em B-E was obtained.

By making use of Em R-G, Em G-E and Em B-E, each of the following coating solutions was simultaneously multicoated on a support comprising polyethylene-laminated paper sheet, so that a silver halide color photographic light-sensitive material for multicolor photographic use was prepared.

The amounts of the components added are expressed in an amount coated in the case of coating a single-coated layer.

SDC-2

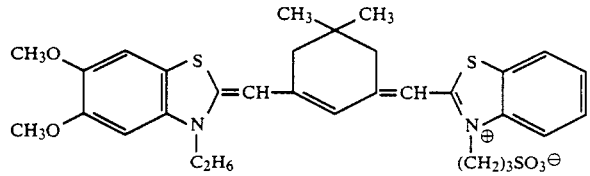

SDM-1

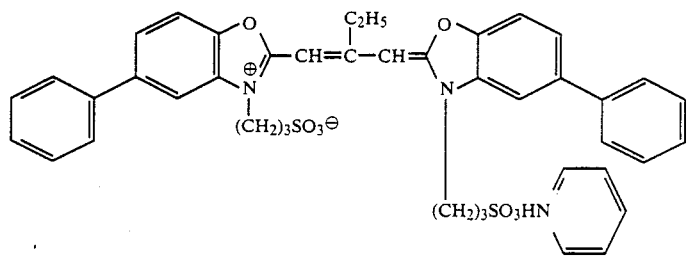

SDY-1 (#43)

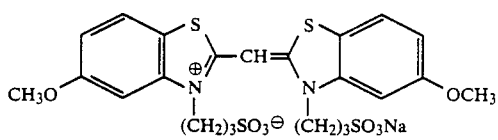

In Samples I-22 and I-23 having used an emulsion having a 100% silver chloride content, each of the fog level is unsatisfactory, even if the dyes of the invention is used.

In contrast to the above, in Samples I-5,I- 8 and I-12 through I-20 each of which has used the emulsions C through E of the invention and the dyes of the invention, it is found to be excellent in characteristics including sensitometry, fog, and sharpness in all.

Also, in Sample I-24 not containing any polyvinyl pyrrolidone, the sharpness thereof is deteriorated.

Example 2

A silver chlorobromide emulsion having a silver chloride content of 99.8 mol% and a silver bromide content of 0.2 mol% was prepared in the same manner as in Example-1, and the resulting emulsion is named Em-G.

To each of Em-E prepared in Example-1 and Em-G prepared in this example, chloroauric acid was added in an amount of $5\times10^{-5}$ mol per mol of silver halide and, then, sodium thio-sulfate was added in an amount of 2 mg per mol of silver halide. The resulting emulsion was chemically sensitized. Next, Em-G was spectrally sensitized with sensitizing dye SDC-2, so that a red-sensitive silver halide emulsion Em R-G was obtained. Em-E was spectrally sensitized with the following sensitizing dye SDM-1, so that a green-sensitive silver halide emulsion Em G-E was obtained. And, Em-E was spectrally sensitized with the following sensitizing dye SDY-1, so

Layer 1 . . . A blue-sensitive silver chlorobromide emulsion layer

This layer contained yellow coupler Y-1 in an amount of 8 mg/dm$^2$, the dye shown in Table-2 in an amount of 0.05 mg/dm$^2$, a blue-sensitive silver chlorobromide emulsion Em B-E in an amount of 3 mg/dm$^2$, in terms of silver content, a high boiling organic solvent HB-1 in an amount of 3 mg/dm$^2$, an inhibitor denoted by the following S-2 in an amount of 2.5 mg/dm$^2$, and gelatin in an amount of 16 mg/dm$^2$.

Layer 2 . . . An interlayer

This layer contained a hydroquinone derivative HQ-1 in an amount of 0.45 mg/dm$^2$ and gelatin in an amount of 4 mg/dm$^2$.

Layer 3 . . . A green-sensitive silver chlorobromide emulsion layer

This layer contained magenta coupler M-1 in an amount of 4 mg/dm$^2$, the dye shown in Table-2 in an amount of 0.1 mg/dm$^2$, a green-sensitive silver chlorobromide emulsion Em G-E in an amount of 3 mg/dm$^2$ in terms of the silver content thereof, a high boiling organic solvent HB-2 in an amount of 4 mg/dm$^2$, an inhibitor S-3 in an amount of 2 mg/dm$^2$, and gelatin in an amount of 16 mg/dm$^2$.

Layer 4 . . . An interlayer

This layer contained UV absorbents UV-1 and UV-2 each in amount of 3 mg/dm$^2$, a high boiling organic solvent HB-1 in an amount of 4 mg/dm$^2$, a hydroquinone derivative HQ-1 in an amount of 0.45 mg/dm$^2$, and gelatin in an amount of 14 mg/dm$^2$.

Layer 5 . . . A red-sensitive silver chlorobromide emulsion layer

This layer contained cyan coupler C-1 in an amount of 3 mg/dm$^2$, a high boiling organic solvent HB-2 in an amount of 2 mg/dm$^2$ a red-sensitive silver chlorobromide emulsion Em R-G in an amount of 2 mg/dm$^2$ in terms of the silver content thereof, the dye shown in Table-2 in an amount of 0.3 mg/dm$^2$, an inhibitor S-1 in an amount of 2 mg/dm$^2$, and gelatin in an amount of 14 mg/dm$^2$.

Layer 6 . . . An interlayer

This layer contained UV absorbents UV-1 and UV-2 each in an amount of 2 mg/dm$^2$, polyvinyl pyrrolidone in an amount of 0.2 mg/dm$^2$, a high boiling organic solvent HB-1 in an amount of 2 mg/dm$^2$, and gelatin in an amount of 6 mg/dm$^2$.

Layer 7 . . . A protective layer

This layer contained a hardener H-1 in an amount of 1.0 mg/dm$^2$, gelatin in an amount of 9 mg/dm$^2$.

Further, Samples II-1 through II-30 each was prepared in the same manner as in the above-mentioned light-sensitive material, except that the compounds represented by Formula I which were added into Layers 1, 3 and 5 were variously changed.

The samples thus prepared were evaluated in the same manner as in Example-1. Wherein, the sample were photographically processed in the same manner as in Example-1 and with the same color developer, bleach-fixer and stabilizer as those used in Example-1. This processing is called Process-A. Separately from the above, the samples were photographically processed in the quite same manner as in Process-A, except that the pH values thereof obtained after the color development were adjusted to be 10.30 and the color developing temperatures in the processing steps were changed to be 37.0±0.3° C. This processing is called Process-B. The results of the photographic characteristics of the samples processed in the respective processing steps are shown in Table-2.

In Table-2, among the dyes used in Layer 5, AI-1, AI-2 and AI-3 each was the same with those used in Example-1j, and the structural formulas of Y-1, M-1, S-2, HB-1, HB-2, UV-1, UV-2, and comparative dyes AI-4, AI-5 and AI-6 are as follows:

Y-1

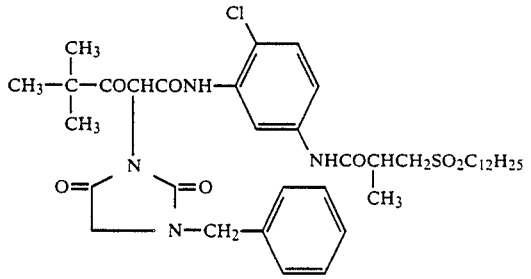

M-1

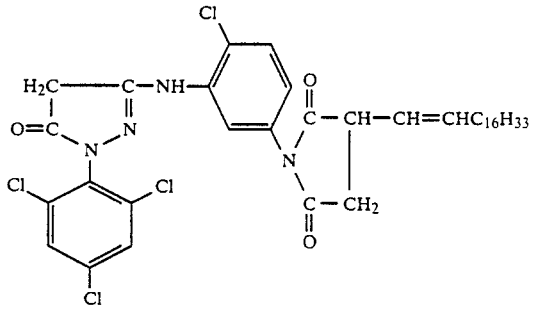

S-2

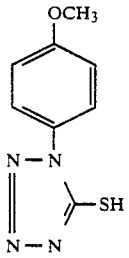

-continued
S-3
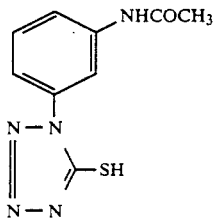
HB-1
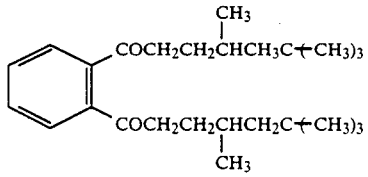
HB-2
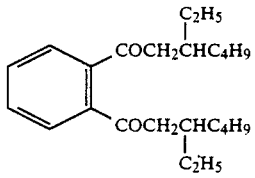
UV-1
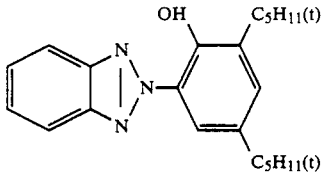
UV-2
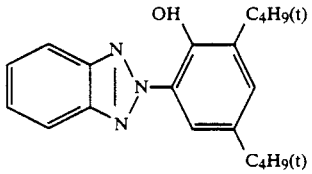
AI-4
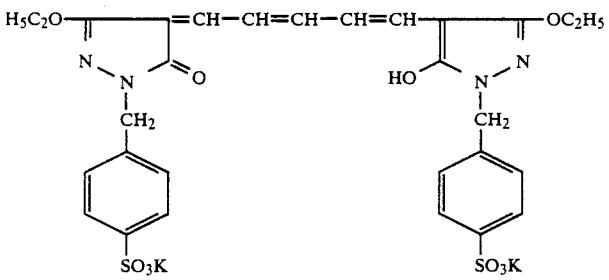
AI-5
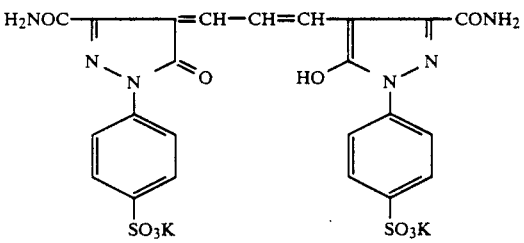

-continued

AI-6

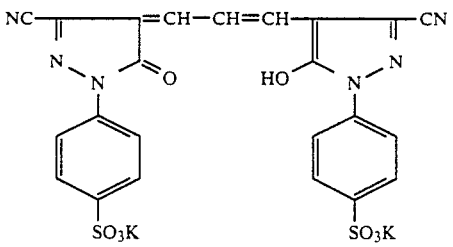

AI-7

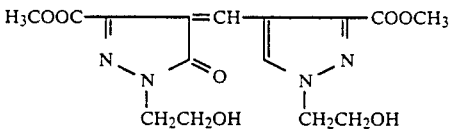

TABLE 2

| Sample No. | Dye in Layer-1 | Dye in Layer-3 | Dye in Layer-5 | Sensitivity variation (Process-B/Process-A) B | G | R | Fog (Process-B) B | G | R |
|---|---|---|---|---|---|---|---|---|---|
| II-1 | — | — | AI-2 | +8 | −2 | 0 | 0.028 | 0.033 | 0.031 |
| II-2 | — | — | AI-3 | +5 | 0 | 0 | 0.025 | 0.032 | 0.032 |
| II-3 | — | — | AI-4 | +6 | −1 | 0 | 0.023 | 0.029 | 0.032 |
| II-4 | — | AI-5 | — | +5 | 0 | 0 | 0.024 | 0.027 | 0.027 |
| II-5 | — | AI-6 | — | +8 | −2 | 0 | 0.027 | 0.030 | 0.026 |
| II-6 | AI-7 | — | — | +6 | 0 | 0 | 0.028 | 0.028 | 0.023 |
| II-7 | AI-7 | AI-6 | AI-3 | +9 | −3 | 0 | 0.030 | 0.036 | 0.034 |
| II-8 | — | — | 54 | 0 | 0 | 0 | 0.017 | 0.019 | 0.016 |
| II-9 | — | — | 58 | 0 | 0 | 0 | 0.017 | 0.019 | 0.017 |
| II-10 | — | — | 61 | +1 | 0 | 0 | 0.017 | 0.020 | 0.019 |
| II-11 | — | — | 65 | 0 | 0 | 0 | 0.017 | 0.018 | 0.016 |
| II-12 | — | — | 68 | +1 | 0 | 0 | 0.018 | 0.019 | 0.017 |
| II-13 | — | — | 70 | +1 | 0 | 0 | 0.018 | 0.019 | 0.018 |
| II-14 | — | — | 72 | 0 | 0 | 0 | 0.017 | 0.018 | 0.016 |
| II-15 | — | — | 76 | 0 | 0 | 0 | 0.017 | 0.018 | 0.016 |
| II-16 | — | — | 81 | +1 | 0 | 0 | 0.018 | 0.018 | 0.017 |
| II-17 | — | — | 86 | +1 | 0 | 0 | 0.018 | 0.019 | 0.016 |
| II-18 | — | — | 88 | +1 | 0 | 0 | 0.018 | 0.019 | 0.018 |
| II-19 | — | 13 | — | 0 | 0 | 0 | 0.018 | 0.019 | 0.017 |
| II-20 | — | 14 | — | 0 | 0 | 0 | 0.017 | 0.018 | 0.016 |
| II-21 | — | 17 | — | +1 | 0 | 0 | 0.018 | 0.018 | 0.017 |
| II-22 | — | 19 | — | +2 | 0 | 0 | 0.019 | 0.019 | 0.017 |
| II-23 | — | 28 | — | +1 | −1 | 0 | 0.018 | 0.018 | 0.018 |
| II-24 | — | 30 | — | 0 | 0 | 0 | 0.017 | 0.018 | 0.016 |
| II-25 | — | 35 | — | +1 | 0 | 0 | 0.019 | 0.018 | 0.017 |
| II-26 | 1 | — | — | 0 | 0 | 0 | 0.019 | 0.018 | 0.016 |
| II-27 | 7 | — | — | 0 | 0 | 0 | 0.021 | 0.019 | 0.017 |
| II-28 | 8 | — | — | 0 | 0 | 0 | 0.018 | 0.018 | 0.016 |
| II-29 | 9 | — | — | 0 | 0 | 0 | 0.017 | 0.018 | 0.017 |
| II-30 | 2 | 32 | 57 | 0 | 0 | 0 | 0.019 | 0.020 | 0.018 |

It is apparent from the result shown in Table-2 that, in the multilayered samples No. II-1 through No. 11-7 each in which the comparative samples were used, the sensitivity variations were serious in both of Process-A and Process-B, and fog was also serious in Process-B.

It can therefore be understood that, in the comparative samples, any stable photographic characteristics cannot be obtained due to the variations of the pH values and temperatures of photographic processing solutions used.

In contrast to the above, it is apparent in samples No. II-8 through No. II-30 each of the invention that there was almost no sensitivity variation in both Processes-A and -B, and very little fog was produced in Process-B, and that the process variation resistance and fogginess thereof were remarkably improved as compared to the comparative samples. These characteristics are vary essential particularly in a rapid processing.

With respect to the samples prepared in Example-2, namely, II-1, II-2, II-5, II-8, II-14, II-17, II-20, II-22, and II-25, the stability thereof against high humid conditions and the humidity dependability thereof at the time of exposure were checked.

The stability of each of the samples was evaluated in terms of the relative sensitivity ratio (%) obtained after the fresh sample was allowed to stand at a temperature of 40° C and a relative humidity of 80%RH, for one week.

The humidity dependability at time of exposure of each of the samples was evaluated in terms of a relative sensitivity ratio {%) obtained after the samples were exposed to light at the temperatures/humidities of 23°. C./85%RH and 23° C./55%RH and were then processed-in the same manner as in Example-1.

With each of the samples, the stability against a high humidity and the humidity dependability at time of exposure were each valuated with the blue-sensitive layer thereof which shows a relatively sharp sensitivity variation.

TABLE 3

| Sample No. | Stability relative sensitivity ratio obtained around standing for one week | Humidity dependability Sensitivity ratio at 23° C., 85%/23° C., 55% | Remark |
|---|---|---|---|
| II-1 | −28% | −14% | Comparative |
| II-2 | −30 | −11 | " |
| II-5 | −31 | −12 | " |
| II-8 | −16 | −2 | Invention |
| II-14 | −14 | −4 | " |
| II-17 | −18 | −7 | " |
| II-20 | −13 | −3 | " |
| II-22 | −19 | −6 | " |
| II-26 | −13 | −4 | " |

It is apparent from the results shown in Table-3 that the comparative samples showed the sharp variations in sensitivity on standing and on changing of humidity at time of exposure and, in contrast to the above, the samples of the invention showed the excellent stability against humidity, but showed almost no sensitivity variation.

What is claimed is:

1. A silver halide photographic light-sensitive material comprising a support and photographic layers containing at least one silver halide emulsion layer thereon, wherein at least one silver halide emulsion layer contains silver halide grains having a silver chloride content of not less than 90 mol% and silver bromide content of not less than 0.05 mol% and at least one of said photographic layer contains a compound represented by the following Formula (I)

Formula (I)

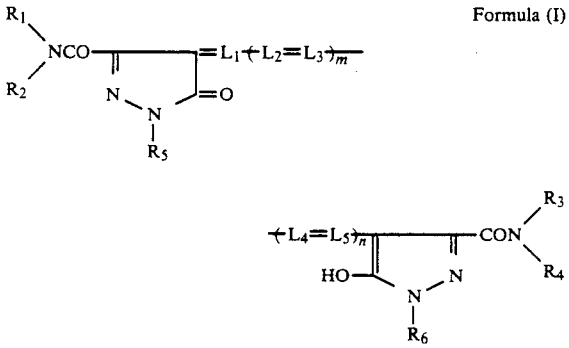

wherein $R_1$, $R_2$, $R_3$, $R_4$, $R_5$, and $R_6$ each represents a hydrogen atom, a substituted alkyl group, an unsubstituted alkyl group, a substituted aryl group, an unsubstituted aryl group, a substituted alkenyl group, an unsubstituted alkenyl group, a substituted heterocyclic group, or an unsubstituted heterocyclic group, provided that $R_1$ and $R_2$ are not a hydrogen atom at the same time, and provided that $R_3$ and $R_4$ are not a hydrogen atom at the same time, and at least one of $R_1$, $R_2$, $R_3$, $R_4$, $R_5$, and $R_6$ is a group having a water-soluble group or a group having a substituent having a water-soluble group, and $L_1$, $L_2$, $L_3$, $L_4$ and $L_5$ each represents a substituted methine group or an unsubstituted methine group and, m and n each is an integer of 0 or 1.

2. The silver halide photographic light-sensitive material as claimed in claim 1, wherein the silver halide grains have a silver chloride content of not less than 95 mol%.

3. The silver halide photographic light-sensitive material as claimed in claim 2, wherein the silver halide grains have a silver bromide content is within the range of 0.1 to 2 mol%.

4. The silver halide photographic light-sensitive material as claimed in claim 1, wherein at least one silver halide emulsion layer contains said silver halide grains in a proportion of not less than 80% by weight of the silver halide grains.

5. The silver halide photographic light-sensitive material as claimed in claim 1, wherein at least one silver halide emulsion layer contains said silver halide grains in a proportion of not less than 90% by weight of the total silver halide grains.

6. The silver halide photographic light-sensitive material as claimed in claim 1, wherein at least one silver halide emulsion layer is blue sensitive and contains a compound represented by the Formula I wherein m and n each is 0.

7. The silver halide photographic light-sensitive material as claimed in claim 1, wherein at least one silver halide emulsion layer is green sensitive and contains a compound represented by the Formula I wherein m is 1 and n is 0.

8. The silver halide photographic light-sensitive material is claimed in claim 1, wherein at least one silver halide emulsion layer is red sensitive and contains a compound represented by the Formula I wherein m and n each is 1.

9. The silver halide photographic light-sensitive material is claimed in claim 1, wherein at least one of photographic layers contains a fluorescent brightening agent scavenger.

10. The silver halide photographic light-sensitive material as claimed in claim 9, wherein said fluorescent brightening agent scavenger is a hydrophilic polymer selected from the group consisting of a polyvinyl pyrrolidone, a copolymer containing vinyl pyrrolidone as its repetition unit and a hydrophilic polymer containing a cationic nitrogen-containing active group.

* * * * *

UNITED STATES PATENT AND TRADEMARK OFFICE

CERTIFICATE OF CORRECTION

PATENT NO. : 4,996,138

DATED : February 26, 1991

INVENTOR(S) : Kazuhiro Murai et al.

It is certified that error appears in the above-identified patent and that said Letters Patent is hereby corrected as shown below:

Title Page:
In the Abstract, Line 5, after "contains" delete "a";

Claim 1, Column 57, Line 31, change "layer" to --layers--;

Claim 3, Column 58, Line 23, after "content" delete "is";

Claim 4, Column 58, Line 29, before "silver" insert --total--;

Claim 8, Column 58, Line 46, before "claimed" change "is" to --as--;

UNITED STATES PATENT AND TRADEMARK OFFICE

CERTIFICATE OF CORRECTION

PATENT NO. : 4,996,138

DATED : February 26, 1991

INVENTOR(S) : Kazuhiro Murai et al

It is certified that error appears in the above-identified patent and that said Letters Patent is hereby corrected as shown below:

Claim 9, Column 58, Line 51, before "claimed" change "is" to --as--.

Signed and Sealed this

Fifth Day of January, 1993

*Attest:*

DOUGLAS B. COMER

*Attesting Officer*

*Acting Commissioner of Patents and Trademarks*